US007931734B2

(12) United States Patent
Moosmüller et al.

(10) Patent No.: US 7,931,734 B2
(45) Date of Patent: Apr. 26, 2011

(54) PARTICLE SEPARATION

(75) Inventors: Hans Moosmüller, Reno, NV (US); Rajan K. Chakrabarty, Reno, NV (US); W. Patrick Arnott, Reno, NV (US)

(73) Assignee: Board of Regents of the Nevada System of Higher Education, on behalf of the Desert Research Institute, Reno, NV (US)

( * ) Notice: Subject to any disclaimer, the term of this patent is extended or adjusted under 35 U.S.C. 154(b) by 416 days.

(21) Appl. No.: 12/165,511

(22) Filed: Jun. 30, 2008

(65) Prior Publication Data

US 2009/0056535 A1 Mar. 5, 2009

Related U.S. Application Data

(60) Provisional application No. 60/968,835, filed on Aug. 29, 2007.

(51) Int. Cl.
*B03C 3/011* (2006.01)

(52) U.S. Cl. ..... 95/31; 73/865.5; 95/69; 95/73; 95/78; 95/79; 96/57; 96/74; 96/75; 96/77; 209/127.1; 209/131

(58) Field of Classification Search ..... 95/2, 3, 95/31, 32, 63, 69, 73, 78, 79, 58, 60; 96/18, 96/19, 26, 57, 74, 75, 77, 27, 80; 55/462; 209/127.1, 129, 131; 73/865.5
See application file for complete search history.

(56) References Cited

U.S. PATENT DOCUMENTS 1,558,382 A 10/1925 Marx
2,454,757 A * 11/1948 Smith ..... 422/186.03
3,138,029 A * 6/1964 Rich ..... 73/865.5
3,520,172 A * 7/1970 Liu et al. ..... 73/28.04
3,532,614 A 10/1970 Shirley
3,679,973 A * 7/1972 Smith et al. ..... 324/71.1
3,763,428 A * 10/1973 Preist ..... 324/71.1
3,853,750 A * 12/1974 Volsy ..... 209/127.1

(Continued)

FOREIGN PATENT DOCUMENTS

GB 2129337 A * 5/1984 ..... 209/129

(Continued)

OTHER PUBLICATIONS

Camata, et al., Deposition of Nanostructured Thin Film for Size-Classified Nanoparticles, NASA 5$^{th}$ Conference on Aerospace Materials, Processes, and Environmental Technology (Nov. 2003).

(Continued)

*Primary Examiner* — Richard L Chiesa
(74) *Attorney, Agent, or Firm* — UNR-DRI Technology Transfer Office; Ryan A. Heck

(57) ABSTRACT

Embodiments of a method for selecting particles, such as based on their morphology, is disclosed. In a particular example, the particles are charged and acquire different amounts of charge, or have different charge distributions, based on their morphology. The particles are then sorted based on their flow properties. In a specific example, the particles are sorted using a differential mobility analyzer, which sorts particles, at least in part, based on their electrical mobility. Given a population of particles with similar electrical mobilities, the disclosed process can be used to sort particles based on the net charge carried by the particle, and thus, given the relationship between charge and morphology, separate the particles based on their morphology.

20 Claims, 8 Drawing Sheets

U.S. PATENT DOCUMENTS

| | | | | |
|---|---|---|---|---|
| 4,172,028 | A * | 10/1979 | Dunn | 209/12.2 |
| 4,290,882 | A | 9/1981 | Dempsey | |
| 4,618,432 | A | 10/1986 | Mintz et al. | |
| 5,118,407 | A * | 6/1992 | Beck et al. | 209/2 |
| 5,421,972 | A | 6/1995 | Hickey et al. | |
| 5,755,333 | A * | 5/1998 | Stencel et al. | 209/127.1 |
| 5,885,330 | A * | 3/1999 | Lee | 95/69 |
| 5,938,041 | A * | 8/1999 | Stencel et al. | 209/127.4 |
| 5,944,875 | A * | 8/1999 | Stencel et al. | 95/57 |
| 6,001,266 | A | 12/1999 | Bier | |
| 6,003,389 | A * | 12/1999 | Flagan et al. | 73/865.5 |
| 6,012,343 | A | 1/2000 | Boulaud et al. | |
| 6,263,744 | B1 * | 7/2001 | Russell et al. | 73/865.5 |
| 6,355,178 | B1 | 3/2002 | Couture et al. | |
| 6,498,313 | B1 * | 12/2002 | Stencel et al. | 209/131 |
| 6,692,627 | B1 | 2/2004 | Russell et al. | |
| 6,761,752 | B2 * | 7/2004 | Fissan et al. | 95/74 |
| 6,797,908 | B2 | 9/2004 | Yan et al. | |
| 6,827,761 | B2 * | 12/2004 | Graham | 95/32 |
| 6,831,273 | B2 | 12/2004 | Jenkins et al. | |
| 6,881,246 | B2 * | 4/2005 | Totoki | 96/26 |
| 7,208,030 | B2 * | 4/2007 | Totoki | 96/19 |
| 7,213,476 | B2 | 5/2007 | Cheng et al. | |
| 7,311,824 | B2 | 12/2007 | Yoshida et al. | |
| 7,361,207 | B1 * | 4/2008 | Coffey et al. | 95/78 |
| 7,605,910 | B2 * | 10/2009 | Ahn | 356/37 |
| 2003/0131727 | A1 | 7/2003 | Fissan et al. | |
| 2003/0192813 | A1 * | 10/2003 | Yan et al. | 209/127.1 |
| 2004/0198887 | A1 | 10/2004 | Brown et al. | |
| 2005/0036924 | A1 | 2/2005 | Nilsen et al. | |
| 2006/0266132 | A1 * | 11/2006 | Cheng et al. | 73/865.5 |
| 2007/0043520 | A1 | 2/2007 | Friedlander et al. | |
| 2007/0148962 | A1 | 6/2007 | Kauppinen et al. | |
| 2007/0234901 | A1 * | 10/2007 | Pletcher et al. | 95/78 |
| 2008/0011876 | A1 | 1/2008 | Ostraat | |
| 2008/0047373 | A1 * | 2/2008 | Ahn | 73/865.5 |

FOREIGN PATENT DOCUMENTS

| | | | |
|---|---|---|---|
| WO | WO2008/005283 | A2 | 1/2008 |
| WO | PCT/US2008/069090 | | 10/2009 |

OTHER PUBLICATIONS

Friedlander, S.K., *Smoke, Dust and Haze*, Wiley Interscience, New York (1977).

Hinds, W.C., *Aerosol Technology*, Wiley Interscience, New York (1999).

*Morphology Control of Materials and Nanoparticles: Advanced Materials Processing and Characterization*, Springer Series in Materials Science, vol. 64, 284 pp., Waseda (Ed.), Springer, New York (2003).

Ryu, Jei Jun, *International Search Report*, PCT Application No. US2008/069090 (Aug. 26, 2009).

Rvu, Jei Jun, *Written Opinion International Searching Authority*, PCT Application No. US2008/069090, (Aug. 26, 2009).

Stolzeriberg, M.R., et al, TDMA FIT User's Manual, vol. 653, PTL, University of Minnesota (1988).

Abdelsayed, M., et al., "Differential Mobility Analysis of Nanoparticles Generated by Laser Vaporization and Controlled Condensation (LVCC)," *J. Nanoparticle Research*, 8(3-4) (2006).

Aitken, R.J., et al., "Manufacture and. Use of Nanomaterials: Current Status in the UK and Global Trends," *Occupational Medicine*, 56;300-306 (2006).

Cai, N., et al., "Comparison of Size and Morphology of Soot Aggregates as Determined by Light-Scattering and Electron Microscope Analysis," *Langmuir*, 9:2861-2867 (1993).

Chakrabarty, R.K., et al., "Emissions from the Laboratory Combustion of Wildland Fuels: Particle Morphology and Size," *J. Geophys. Res.*, 111(D07204), doe:10.1029/2005JD006659 (2006).

Chakrabarty, R.K., et al,, "Morphology Based Particle Segregation by Electrostatic Charge," *J. Aerosol Sci.*, 39:785-792 (2008).

Chapot, D., et al., "Electrostatic Potential Around Charged Finite Rodlike Macromolecules: Nonlinear Poisson-Boltzmann Theory," *J. Colloid and Interface Sci.*, 285:609-618 (2005).

DeCarlo, et al., "Particle Morphology and Density Characterization by Combined Mobility and Aerodynamic Diameter Measurements. Part 1: Theoiy," *Aerosol Sci. Tech.*, 38:1185-1205 (2004).

Dhaubhadel, R.F., et al, "Hybrid Superaggregate Morphology as a Result of Aggregation in a Cluster-Dense Aerosol," *Physical Review E*, 73, 011404 (2006).

Ebbesen, T.W., et al., "Large-Scale Synthesis of Carbon Nanotubes," *Nature*, 358(6383):220-222 (1992).

Forrest, S.R., et al., "Long-Range Correlations in Smoke-Particle Aggregates," *J. Phys. A: Math. Gen.*, 12:L109-L117 (1979).

Height, M.J., et al., "Flame Synthesis of Single-Walled Carbon Nanotubes," *Carbon*, 42(11):2295-2307 (2004).

Hwang, W., et al., "Separation of Nanoparticles in Different Sizes and Compositions by Capillary Electrophoresis," *Bull. Korean Chem. Soc.*, 24(5): 684-686 (2003).

Intra, P., et al., "An Overview of Aerosol Particle Sensors for Size Distribution Measurement," *Mj. Int. J. Sci. Tech.*, 01(02):120-136 (2007).

Joutsensaari, J., et al., "A Novel Tandem Differential Mobility Analyzer with Organic Vapor Treatment of Aerosol Particles," *Atmos. Chem. Phys.*, 1:51-60 (2001).

Jullien, R, et al., *Aggregation and Fractal Aggregates*, World Scientific, Singapore (1987) pp. ix, 120 pp.

Kaye, B.H., *A Random Walk Through Fractal Dimensions*, VCH Publishers, New York (1989).

Knutson, E.O., et al., "Aerosol Classification by Electric mobility: Apparatus, Theory, and Applications," *J. Aerosol Sci.*, 6(6):443-451 (1975).

Kousaka, Y., et al., "Bipolar Charging of Ultrafine Aerosol Particles," *Aerosol Sci. Tech.*, 2:421-427 (1983).

Köylü, Ü.Ö., et al., "Fractal and Projected Structure Properties of Soot Aggregates," *Combust. Flame*, 100:621-633 (1995).

Liu, F., et al., "Separation and Study of the Optical Properties of Silver Nanocubes by Capillary Electrophoresis," *Chemistry Letters*, 33(7):902-903 (2004).

Mulholland, G.W. et al., "Nanometer Calibration Particles: What is Available and What is Needed?," *Journal of Nanoparticle Research*, 2(1):5-15 (2000).

Mulholland, G. W., et al., "Selection of Calibration particles for Scanning Surface Inspection Systems," *SPIE*, 2862:104-118 (1996).

Oh, C., et al., "The Effect of Overlap between Monomers on the Determination of Fractal Cluster Morphology," *J. Colloid Interface Sci.*, 193:17-25 (1997).

Ostraat, J., et al., "Synthesis and Characterization of Aerosol Silicon Nanocrystal Nonvolatile Floating-Gate Memory Devices," *Applied Physics Letters*, 79(3):433-435 (2001).

Owada, S., et al.. "'Dry Flotation': A Novel Electrostatic Separation by Modifying Particle Surface with Surfactant and Electrolyte," *Resources Processing*, 53:29-33 (2006).

Pearson, E.F., "Revisiting Millikan's Oil-Drop Experiment," *Journal of Chemical Education*, 82:851-854 (2005).

Pratsinis, S.F., "Flame aerosol Synthesis of ceramic powders," *Progress in Energy and Combustion Science*, 24(3):197-219 (1998).

Rao, C.N.R., "New Developments in Nano Materials," *Journal of Materials Chemistry*, 14(4):E4 (2004).

Rodrigues, M.V., et al., "Measurement of the Electrostatic Charge in Airborne Particles: II—Particle Charge Distribution of Different Aerosols," *Braz. J. Chem. Eng.*, 23(1):125-133 (2006).

Rogak, S.N., et al, "Bipolar Diffusion Charging of Spheres and Agglomerate Aerosol Particles," *J. Aerosol Sci.*, 23:693-710 (1992).

Rogak, S.N., et al., "The Mobility and Structure of Aerosol Agglomerates," *Aerosol Sci. Tech.*, 18:25-47 (1993).

Samson, R.J., et al., "Structural Analysis of Soot Agglomerates," *Langmuir*, 3(2):272-281 (1987).

Schnabel, U., et al., "Characterization of Colloidal Gold Nanoparticles According to Size by Capillary Zone Electrophoresis," *J. Micro Sep.* 9(7):529-534 (1997).

Seto, T., et al., "Evaluation of Morphology and Size Distribution of Silicon and Titanium Oxide Nanoparticles Generated by Laser Ablation," *J. Nanoparticle Research*, 3:185-191 (2001).

Slowik, J.G., et at, "Particle Morphology and Density Characterization by Combined Mobility and Aerodynamic Diameter Measurements, Part 2: Application to Combustion-Generated Soot Aerosol as a Function of Fuel Equivalence Ratio," *Aerosol Sci. Tech.*, 38:1206-1222 (2004).
Slowik, J.G., et al., "An Inter-Comparison of Instruments Measuring Black Carbon Content of Soot Particles," *Aerosol Sci.Tech.*, 41:295-314 (2007).
Stevens, M.M., et al., "Exploring, and Engineering the Cell Surface Interface," *Science*, 310(5751):1135-1138 (2005).
Ulrich, G.D., "Flame Synthesis of Fine Particles," *Chemical & Engineering News*, 62 (32):22-29 (1984).
VDI Technologiezentrum GmbH, Future Technologies Division, "Industrial Application of Nanomaterials—Chances and Risk" vol. 54, 111 pp, Luther, W. (Ed.), (2004) Dusseldorf.
Wang, S.C., et al., "Scanning Electrical Mobility Spectrometer," *Aerosol Sci. Tech.*, 13:230-240 (1990).
Wen, H.Y., et al., "Bipolar Diffusion Charging of Fibrous Aerosol Particles—I. Charging Theory," *J. Aerosol Sci.*, 15:89-101 (1984).
Wen, H.Y., et al., "Bipolar Diffusion Charging of Fibrous Aerosol Particles—II. Charge and Electrical Mobility Measurements on Linear Chain Aggregates," *J. Aerosol Sci.*, 15:103-122 (1984).
Yeh, H., et al., "Theoretical Study of Equilibrium Bipolar Charge Distribution on Nonuniform Primary Straight Chain Aggregate Aerosols," *Aerosol Sci. Tech.*, 2:383-388 (1983).
Zelenyuk, A., et al., "On the Effect of Particle Alignment in the DMA," *Aerosol Sci. Tech.*, 41(2):112-124 (2007).
Manual for the Series 3080 Electrostatic Classifiers, TSI, Minnesota (2006).
Manual for the Series 3936 Scanning Mobility Particle Sizer (SMPS), TSI, Minnesota (2003).

* cited by examiner

PARTICLE SEPARATION

CROSS REFERENCE TO RELATED APPLICATIONS

This application claims the benefit of, and incorporates by reference, U.S. Provisional Patent Application No. 60/968,835, filed Aug. 29, 2007.

STATEMENT OF GOVERNMENT SUPPORT

This invention was made with United States Government support under grants from the U.S. Department of Energy Atmospheric Science Program, grants DE-FG02-05ER64008, DE-FG02-98ER62581, and DE-FG02-05ER63995; the National Air and Space Administration (NASA) Upper Atmosphere Research Program, contract NAG2-1462, and Atmospheric Chemistry Program contract NNH04CC09C; and the National Science Foundation, grant Nos. ATM-0212464, ATM-0525355, and 0447416. The United States Government has certain rights in the invention.

FIELD

The present disclosure relates, generally, to a method and system for separating particles having different morphologies or flow properties. In a specific example, particles are separated based on their electrical mobility.

BACKGROUND

Morphology can be an important property in particle-related applications. For example, morphology may be a factor in aerosol synthesis, which can be used for bulk production of nanomaterials, such as in—1) pharmaceuticals synthesis and processing, where the ability to control the size and state of agglomerates can influence their behavior in the human body; 2) synthesis of printer toners, tires, paints, fillers, and fiber-optics products, where nanopowders morphology uniformity can influence product quality; and 3) carbon nanotube manufacturing, where uniformly sized and shaped carbon nanotubes may have desirable properties.

When used to produce particles beyond a certain length, aerosol formation mechanisms can produce agglomerates. Agglomerates can have complex, fractal-like morphologies, and particles having the same mass, such as being composed of the same number of individual particles, can have different morphologies, such as being more spherically or more linearly shaped. Segregating agglomerate ensembles based on their morphology can be difficult; there is no well-established technique.

SUMMARY

The present disclosure provides a method for separating particles having different morphologies based on their flow properties, such as their electrical mobility. In a specific embodiment, the aerosol is charged, such as with a bipolar charger, before the particles are separated based on their flow properties. In one example, charging produces at least a first distribution of a flow property and the particles are separated based on the first distribution. In a more specific example, the separated particles are charged again to produce at least a second distribution of a flow property. The separated particles are further separated based on the second distribution.

In an implementation of this example, an aerosol having a plurality of particle morphologies is charged. Particles having a first electrical mobility-to-charge ratio are separated from particles having a second electrical mobility-to-charge ratio. The particles of the first electrical mobility-to-charge ratio are selected particles. A charge is applied to the selected particles to produce particles having a first morphology and a first electrical mobility and particles having a second morphology and a second electrical mobility. The particles of the first electrical mobility are separated from particles having the second electrical mobility.

In a more particular implementation of this example, particles having the first and second electrical mobility-to-charge ratios are separated using a differential mobility analyzer. In a more particular implementation, particles having the first and second electrical mobilities are also separated using a differential mobility analyzer.

According to another configuration, the first electrical mobility corresponds to the product of the first electrical mobility-to-charge ratio and the number of elementary charges of the multiply-charged particles.

In further examples, the method includes size selecting particles in the aerosol prior to separating the particles based on their flow properties, such as by passing the particles through a differential mobility analyzer or an impactor. In yet another example, the particles are size selected before being charged. In yet further examples, the aerosol is cooled before it is charged and the particles separated based on their flow properties, such as to produce a higher concentration of particles having a particular electrical mobility. In another example, the differential mobility analyzers have a sample flow rate and a sheath flow rate and the ratio of the sample flow rate to the sheath flow rate is greater than about 1:5, such as about 1:4.

The particles may be of a variety of shapes, compositions, charges, and sizes. In some examples, the particles are agglomerates of smaller particles. Typical particle samples have a mean particle size, such as cross-sectional diameter, between about 1 nm and about 100 μm, such as between about 50 nm and about 1 μm or between about 200 nm and about 700 nm. The shape of the particles can be expressed in terms of the volume-to-surface area ratio, or density fractal dimension. Typical particles have a fractal dimension of between about 1 and about 3, more typically between greater than 1 and about 2, such as between about 1.2 and about 1.8. Lower volume-to-surface area ratios, or density fractal dimensions, can indicate less spherical particles, such as more linear particles.

In some embodiments, the likelihood of a particle acquiring a certain number of charges in a charging process depends on its morphology. For example, more elongated particles may be more likely to acquire a second charge than spherical particles as, for the same particle mass, the second charge can be located farther from the first charge, thereby requiring less energy for the charging process. In further implementations, the particles are then separated based on their flow properties In some embodiments, the particles are at least partially charge deformable. Charge deformable means that the particles change shape, such as elongating, when charged, such as with an electrostatic charge. Some embodiments of the present disclosure provide for charging particles, at least a portion of which are at least partially charge-deformable. Charging the particles thus alters the morphology of at least a portion of the particles. In further implementations, the particles are then separated based on their flow properties.

The present disclosure also provides a system for particle separation. The system includes a first differential mobility analyzer fluidly coupled to a second differential mobility analyzer. The first differential mobility analyzer is configured to produce an at least substantially monodisperse aerosol of particles having a desired electrical mobility-to-charge ratio, the monodisperse aerosol comprising particles bearing one elementary charge and particles bearing multiple elementary charges. The second differential mobility analyzer is configured to select as its primary mode particles having an electrical mobility corresponding to the product of the desired electrical mobility-to-charge ratio and the number of elementary charges on the multiply-charged particles.

There are additional features and advantages of the subject matter described herein. They will become apparent as this specification proceeds.

In this regard, it is to be understood that this is a brief summary of varying aspects of the subject matter described herein. The various features described in this section and below for various embodiments may be used in combination or separately. Any particular embodiment need not provide all features noted above, nor solve all problems or address all issues in the prior art noted above.

DETAILED DESCRIPTION

Figure 1:
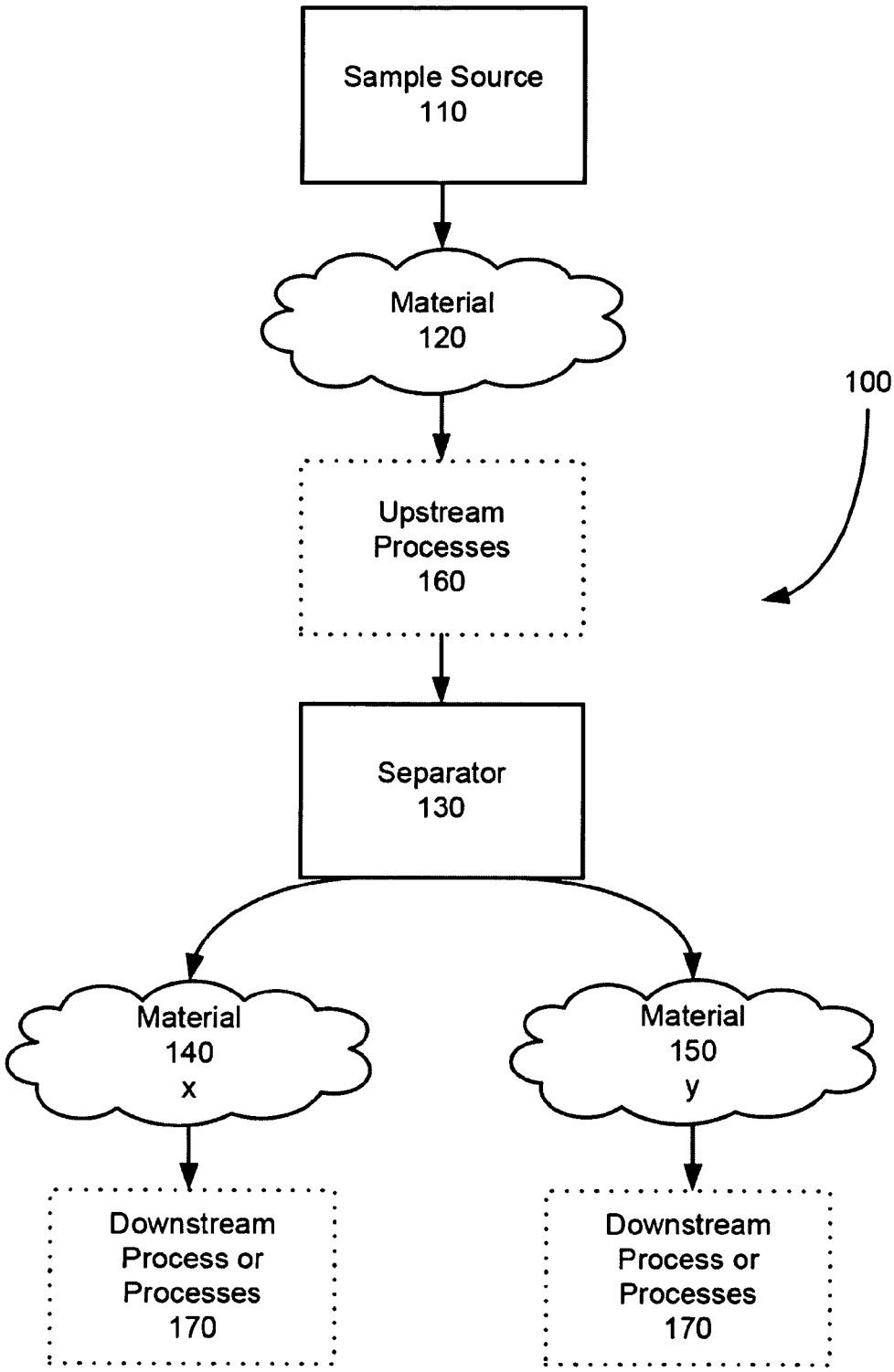
FIG. 1 is a schematic diagram illustrating one embodiment of a process for separating particles having different morphologies.

Unless otherwise explained, all technical and scientific terms used herein have the same meaning as commonly understood by one of ordinary skill in the art to which this disclosure belongs. In case of any such conflict, or a conflict between the present disclosure and any document referred to herein, the present specification, including explanations of terms, will control. The singular terms "a," "an," and "the" include plural referents unless context clearly indicates otherwise. Similarly, the word "or" is intended to include "and" unless the context clearly indicates otherwise. The term "comprising" means "including;" hence, "comprising A or B" means including A or B, as well as A and B together. All numerical ranges given herein include all values, including end values (unless specifically excluded) and intermediate ranges.

Although methods and materials similar or equivalent to those described herein can be used in the practice or testing of the present disclosure, suitable methods and materials are described herein. The disclosed materials, methods, and examples are illustrative only and not intended to be limiting.

"Aerosol" refers to a dispersion of particles in a fluid medium, such as a gas, or in a vacuum. In some examples, the gas is air. Aerosols may be formed by a variety of methods, including ablation, flame synthesis, spray drying of colloidal or precipitated particles, spray pyrolysis, and thermal evaporation. The particle concentration in the aerosol is typically selected to provide suitable particle separation in the method of the present disclosure, or based on how the particles will be used after separation. In some examples the particle concentration is between about $10^1$ particles/cm$^3$ and about $10^{13}$ particles/cm$^3$, such as between about $10^4$ particles/cm$^3$ and about $10^{11}$ particles/cm$^3$ or between about $10^7$ particles/cm$^3$ and about $10^9$ particles/cm$^3$.

"Flow properties" refers to the influence of electrostatic and/or electrodynamic forces by themselves or in combination with other forces such as inertial, viscous, magnetic, or gravitational forces, optionally with the use of spatial or temporal gates, on a particle's movement in a fluid medium or a vacuum. In one example, the flow property is electrical mobility. According to the present disclosure, flow properties can be influenced by external forces in order to separate particles based on their morphologies.

In one example, time-of-flight techniques, such as time-of-flight mass spectrometry, are used to separate particles based on electrodynamic forces. In another example, an electrostatic classifier is used to influence the flow properties of a particle using viscous and electrostatic forces. A Millikan apparatus, using gravity and electrostatic forces, can be used to separate particles.

"Mobility diameter," or $D_m$, is a parameter used to characterize particles and refers to the diameter of an equivalent sphere having the same electrical mobility as the particle in question, which may be nonspherical.

"Nanostructure" refers to a solid structure having a cross sectional diameter of between about 0.5 nm to about 500 nm. Nanostructures may be made from a variety of materials, such as carbon, silicon, and metals, including, without limitation, titanium, zirconium, aluminum, cerium, yttrium, neodymium, iron, antimony, silver, lithium, strontium, barium, ruthenium, tungsten, nickel, tin, zinc, tantalum, molybdenum, chromium, and compounds and mixtures thereof. Suitable materials that also are within the definition of nanostructures include transition metal chalcogenides or oxides, including mixed metal and/or mixed chalcogenide and/or mixed oxide compounds or carbonaceous compounds, including elemental carbon, organic carbon, and fullerenes, such as buckyballs, and related structures. In particular examples, the nanostructure is made from one or more of zinc oxide, titanium dioxide, gallium nitride, indium oxide, tin dioxide, magnesium oxide, tungsten trioxide, and nickel oxide.

The nanostructure can be formed in a variety of shapes. In one implementation, the nanostructures are wires, such as wires having at least one cross sectional dimension less than about 500 nm, such as between about 0.5 nm and about 200 nm. Nanowires can be nanorods, having a solid core, or nanotubes having a hollow core. In some implementations, the cross sectional dimension of the nanostructure is relatively constant. However, the cross sectional dimension of the nanostructure can vary in other implementations, such as rods or tubes having a taper.

As used herein, "particle" refers to a small piece of an element, compound, or other material. Particles that may be used in the present disclosure include those having a size, such as a cross-sectional diameter, of between about 1 nm and about 100 μm, such as between about 50 nm and about 1 μm or between about 200 nm and about 700 nm. The shape or morphology of the particles can be expressed in terms of the volume-to-surface area ratio, or density fractal dimension. Typical particles have a fractal dimension of between about 1 and about 3, typically greater than 1 and less than 2, such as between about 1.2 and about 1.8. The particles may be of any form, such as powders, granules, pellets, strands, or flocculent materials. The particles may be individual, discrete units, agglomerations of multiple units, or mixtures thereof. Particle agglomerates can assume a number of shapes. As the number of particles in the agglomerate increases, the number of potential morphologies also typically increases. Even relatively small agglomerates typically can exist in a number of different morphologies. When the morphology plays a role in the function of the particles, morphological separation may be important, and difficult to achieve using prior methods.

The particles may be of any desired material that can be charged for the separation process, or that is mixed with such a material. For example, the particles may be, or include, carbonaceous materials, ceramics (such as metal borides, carbides, or nitrides), extenders, fillers, inorganic salts, metals, metal alloys, metal alkoxides, metal oxides, pigments, polymers, zeolites, or combinations and mixtures thereof. Specific examples of such materials include aluminum, antimony oxide, asbestos, attapulgite, barium sulfate, boehmite, calcium carbonate, chalk, carbon black, chromium, cobalt, copper, diatomaceous earth, fumed oxides, gold, halloysite, iron, iron oxides, kaolin, molybdenum, montmorillonite, nickel, niobium, palladium, platinum, silica, silica aerogels, silica sols, silicon, silver, tantalum, titania, titanium, titanium isopropoxide, zinc oxide, zinc sulfide, or alloys, mixtures, or combinations thereof.

In some examples, the particles can be used to form nanostructures, such as nanorods or nanotubes. The disclosed systems, apparatus, and methods can be used to separate particles, such as nanoparticles, having different morphologies and, optionally, other differences. In some examples, the particles are combustion particles, such as carbon black.

One particle property is electric charge. At a given temperature, particles typically have a Boltzmann distribution of positively charged, negatively charged, and neutral particles. Particles may be further charged by various mechanisms, including static electrification, such as electrolytic charging, spray electrification, or contact charging. Field charging may also be used. Other forms of charging include corona discharge, radioactive discharge, ultraviolet radiation, and flame ionization. In some implementations, a combination of charging mechanisms is used.

In a specific example, bipolar charging is used. In bipolar charging, positive and negative charges are applied to the particles, such as by interacting the particles with bipolar ions. The net charge on the particles following bipolar charging may be negative, positive, or neutral. When charged, the particles may have at least one charge, but potentially may be multiply charged.

The distribution of charges is typically related to temperature. In some examples, a sample is cooled prior to charging in order to produce a desired distribution. For example, higher temperatures may facilitate multiple morphologies being multiply-charged, which may make separation less efficient. Cooling the sample can increase the probability that the more linear morphologies are multiply-charged rather then more spherical morphologies.

In some embodiments, the particles are at least partially charge deformable. "Charge deformable" means that the particles change shape, such as elongating, when charged, such as with an electrostatic charge. Charge deformable particles are typically at least partially flexible. In some examples, particles elongate when a charge, or charges, is applied or increased. In another example, particles assume a more spherical shape when charge is removed or reduced.

The following equation provides a relationship between mobility and particle size:

$$Z_p = \frac{ieC_c}{3\pi\mu D_p} \tag{1}$$

In Equation 1, e is the elementary charge, i is the number of elementary charges carried by a particle (typically an integer), $C_c$ is the slip correction factor (defined later in this disclosure), and μ is the gas viscosity. As can be seen from this equation, for a given mobility $Z_p$, more highly charged particles will have a larger $D_p$ compared with less charged particles.

In various embodiments of the present disclosure, particles with a certain charge can be selected using forces that depend on the charge, such as electrostatic and/or electrodynamic forces by themselves or in combination with other forces such as inertial, viscous, or gravitational forces or with the use of spatial or temporal gates. In a specific example presented in the present disclosure, particles with a certain charge are selected using a differential mobility analyzer. The differential mobility analyzer uses a combination of viscous and electrostatic forces to select a combination of charge q and aerodynamic particle size with a spatial gate.

A schematic diagram of a process for separating particles based on flow properties 100 is presented in FIG. 1. A sample source 110 produces a material 120 having a plurality of particles, at least a portion of which differ at least in their morphology, although the particles of the portion may differ in other properties, such as size.

The material 120 is typically dispersed in a carrier fluid, such as a gas. In one example, the gas is air. The concentration of the material 120 in the carrier gas may depend on a number of factors, such as the type of separator used in the process 100, the flow rate of the material 120 through the separator, the properties of the material 120, such as its size, size distribution, morphology, morphology distribution, or other chemical or physical properties. For example, in at least some processes it may be desirable to keep the concentration of the material 120 below a certain level to avoid undesired particle agglomeration.

A variety of methods are known to prepare suitable concentrations of particles 120 in a carrier. For example, particles, such as carbon black particles, can be produced by flame combustion. Ablation of solid materials is another technique that can be used to generate the particles 120.

The material 120 is passed through a separator 130 that separates the material 120, at least in part, based on morphology. Suitable separators 130 include those that can separate materials based on their flow properties, such as their electrical mobility. One suitable separator 130 that can separate particles on their electrical mobility is the differential mobility analyzer. Suitable differential mobility analyzers include the Series 3080 electrostatic classifiers, available from TSI, Inc. of Shoreview, Minn. Details of an instrument that allows relatively high particle concentrations to be used are described in Camata et al., "Deposition of Nanostructured Thin Film from Size-Classified Nanoparticles," NASA 5th Conference on Aerospace Materials, Processes, and Environmental Technology (November 2003), incorporated by reference herein to the extent not inconsistent with the present disclosure. In some aspects, the process 100 separates the material 120 only on the basis of morphology. In other aspects, the process 100 separates the material 120 based on morphology and at least one other property, such as size or charge.

As shown in FIG. 1, the separator 130 separates the material 120 into two subsets, one set 140 has a charge of xe and another set 150 has a charge of ye. In at least some examples, x and y are integers and the overall charge is xq or yq, where q is the elementary charge of $1.602176487\times10^{-19}$ C. The separator 130 may separate the material into more than two subsets. Each subset may have particles having only a single charge, or single distribution of charges, or may have multiple charges or charge distributions. At least one subset may have a random charge distribution.

Although FIG. 1 illustrates a single separator 130, alternative embodiments of the system 100 may include multiple separators. When multiple separators 130 are used, the separators 130 may be the same or different. Multiple separators 130 may be desirable, for example, when the material 120 includes more than two morphologies or particle sizes that are desired to be separated. When multiple separators 130 are used, additional processes (not shown) may be performed on the material 120 after it exits the separator 130 and before it enters one or more additional separators. When multiple separators 130 are used, they may be present as discrete components or devices or may be a unitary device.

The system 100 optionally includes one or more upstream processes 160. One upstream process may consist of size selection. Suitable impactors and virtual impactors are commercially available, such as the Sioutas Cascade Impactor from SKC Inc., of Eighty Four, Pa. and the Model 3306 Impactor Inlet from TSI Inc., of Shoreview, Minn. Size selection may be useful, for example, in providing an initial separation of the material 120 to remove undesired components, such as particles outside a desired particle range. In one example, size selection is accomplished using an impactor or a virtual impactor.

Upstream processes 160, such as size selection, may be useful in reducing fouling of the separator 130 or in increasing separator 130 efficiency or producing more desirable subsets 140 or 150.

The system 100 optionally includes one or more downstream processes 170. Downstream processes 170 can include, but are not limited to, treatment, detection, or separation processes.

Figure 2:
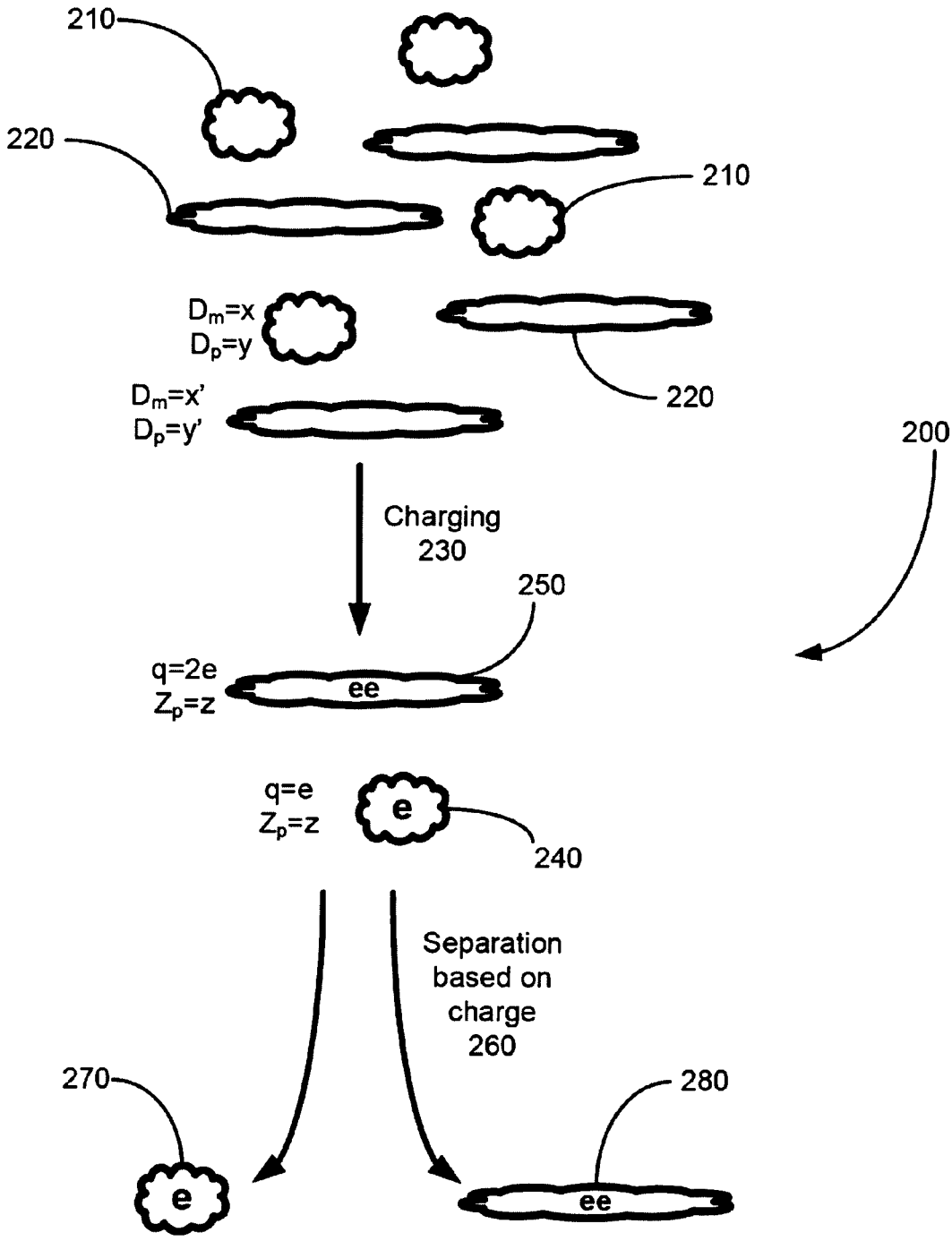
FIG. 2 is a schematic illustration of particles of different morphologies being separated based on their charge.

FIG. 2 is a schematic illustration of how particle properties may be used to separate particles of different morphologies. In the illustrated process 200, two types of particles are shown. Particles 210 have a more spherical morphology and, if the particles 210 are of the same type, will have a particle mobility diameter ($D_m$) of x and a particle diameter ($D_p$), or size, of y. Particles 220 have a more linear morphology, giving rise to a smaller particle mobility diameter x', and a larger maximum particle dimension y'. Generally, the more linear a particle, the smaller it's $D_m$ compared with a spherical particle of similar mass. Stated another way, the electrical mobility of linear particles is equivalent to that of a smaller sized sphere.

In process 230, the particles 210 and 220 are charged. As shown in FIG. 2, the more spherical particles 210 have a lower probability of being multiply-charged, and thus are shown as singly-charged particles 240. More linear particles 220 have a higher probability of being multiply-charged and thus are shown as multiply-charged particles 250. Separating the particles 240 and 250 in the process 260 based on charge thus has the effect of concentrating the two output streams 270 and 280 in particles of a particular morphology.

Figure 3:
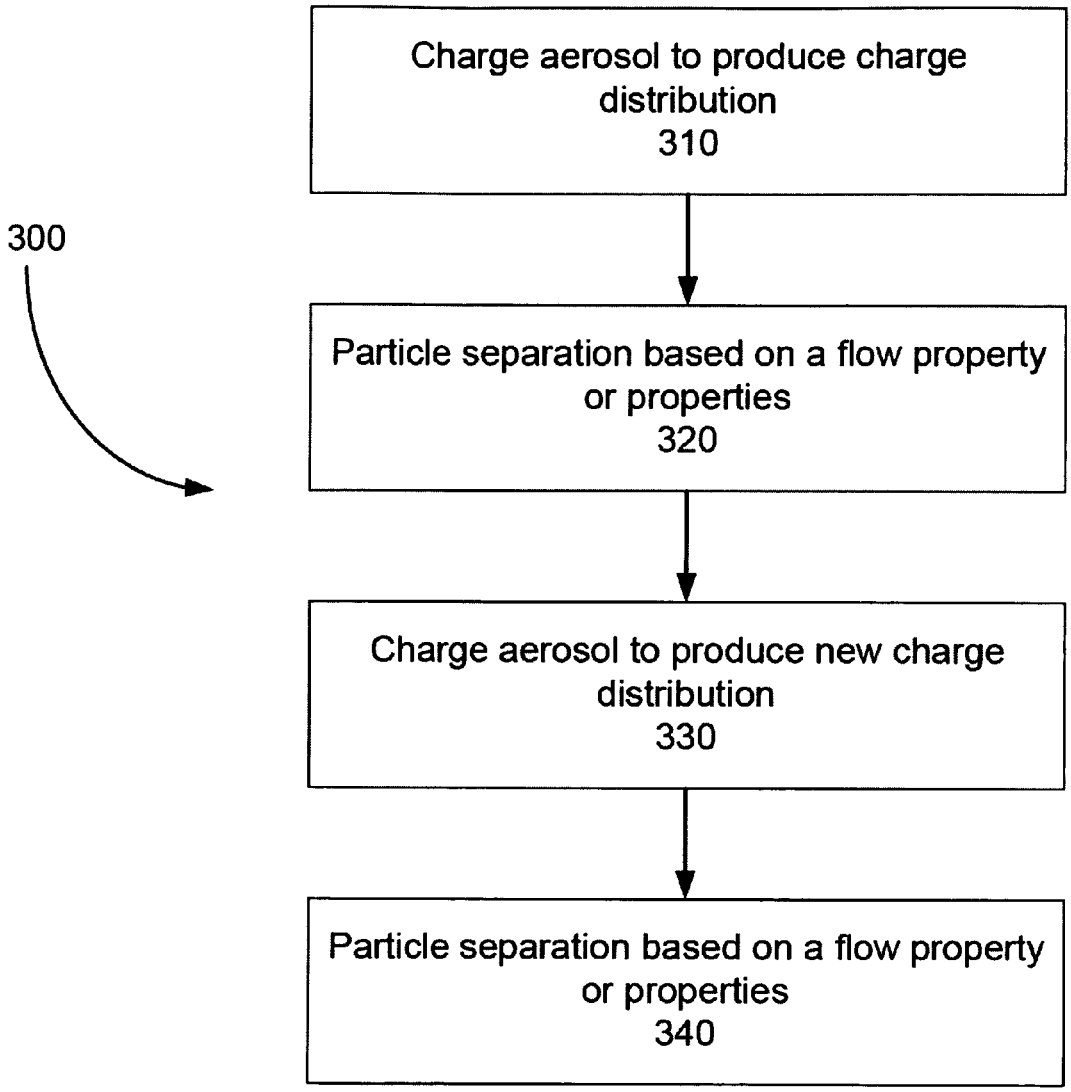
FIG. 3 is a flowchart of an example of the disclosed method.

FIG. 3 illustrates an example 300 of the disclosed method. In step 310, a first aerosol is charged, such as with bipolar charging. Charging process 310 produces a charge distribution for the particles in the aerosol. For example, when biopolar charging is used, some particles will be negatively charged, some particles will be positively charged, and some particles will be neutral. For charged particles, while the majority of the charged particles will have a single charge, a portion will be multiply-charged.

In step 320, a portion of the particles in the aerosol are separated based on their flow properties. In a specific example that will be discussed in detail in the present disclosure, a differential mobility analyzer is used to separate the particles based on their electrical mobility. In this example, particles having a desired electrical mobility are selected away from other particles in step 320.

In some configurations, the desired separation is completed in step 320. In other examples, such as when the aerosol includes a larger variety of particle shapes and sizes, the particles selected in step 320 are subjected to an additional separation step.

In step 330, the aerosol is charged again, such as using a bipolar charger. This charging typically erases the original charge distribution and applies a new charge distribution. In other words, the probability of a particle bearing one charge or bearing multiple charges is determined as if the particles were neutralized and in a similar state as prior to the first charging process 310. Thus, those particles that were multiply-charged after step 310 are now likely to be singly-charged. The formerly multiply-charged particles, when charged with a single charge, now have an electrical mobility different than the particles which were singly-charged after step 310 and selected in step 320 (and which are likely to still be singly-charged after charging step 330). Because the particles selected in step 320 now have different flow properties, they can be selected based on those properties, such as in another differential mobility analyzer, in step 340. As the originally multiply-charged particles had a greater probability of being more linear, the effect of steps 320 and 340 is to separate those more linear particles from more spherically shaped particles.

Figure 4:
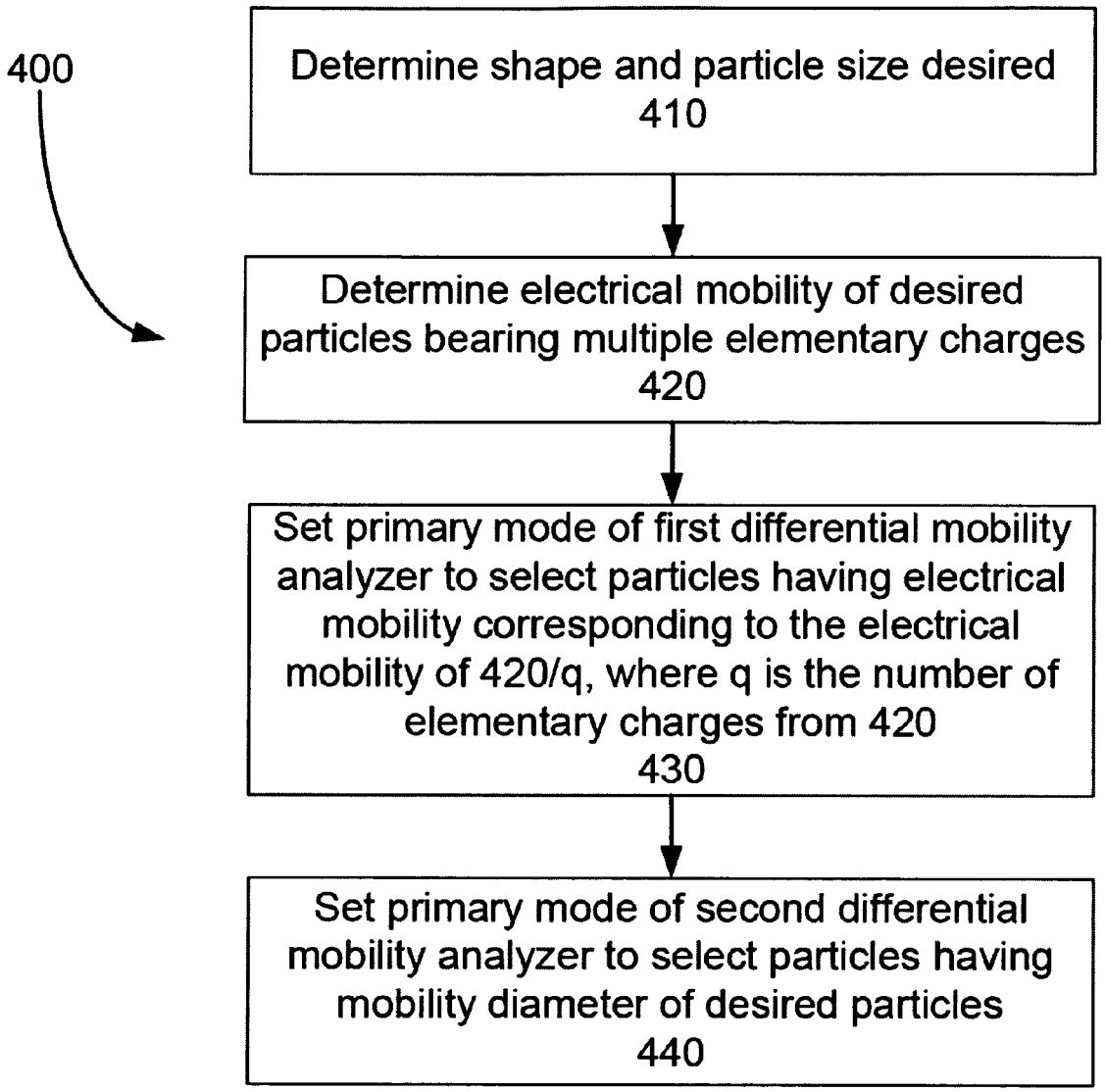
FIG. 4 is a flowchart of an example process for carrying out the disclosed method.

FIG. 4 presents an example 400 of the disclosed method that may be used when sequential electrostatic classifiers (the combination of a neutralizer and a differential mobility analyzer) are used to carry out the method of FIG. 3. In step 410, the shape and particle size of the desired particles are determined. Hypothetically, assume that more linearly shaped particles with a mobility diameter of 400 nanometers are desired.

Because more linearly shaped particles are desired, it can be assumed that they have a higher probability of being multiply-charged after bipolar charging. In step 420, the electrical mobility of the desired particles is determined for such particles bearing a single elementary charge. For simplicity, assume that this electrical mobility is simply the electrical mobility of the multiply-charged particles divided by the number of elementary charges carried by the particle. For example, for doubly-charged particles in the hypothetical, the electrical mobility would be 200 nanometers. In practice, the relationship between electrical mobility and charge has a more complicated relationship, but can be calculated by:

$$Z_p = \frac{neC_c(d_m)}{3\pi\eta d_m} \quad (2)$$

In Equation 2, $Z_p$ is the electrical mobility, n is the number of elementary charges on the particle, $C_c(d_m)$ is the Cunningham slip correction factor, η is the gas dynamic velocity, and $d_m$ is the electrical mobility diameter. Additional details on electrical mobility and other particle properties can be found in DeCarlo et al., Aerosol Science and Technology, 38, 1185-1205 (2004), incorporated by reference herein to the extent not inconsistent with the present disclosure.

In step 430, the primary mode of a first electrostatic classifier is set to the electrical mobility determined in step 420; 200 nanometers in the hypothetical. When a charged sample is passed through the differential mobility analyzer portion of the electrostatic classifier, particles having an electrical mobility corresponding to integer multiples of the primary mode will be transmitted, that is, having a particular electrical mobility-to-charge ratio. In the hypothetical, the desired particles having an electrical mobility of 400 nanometers are selected, as are singly-charged particles having an electrical mobility of 200 nanometers.

The primary mode of a second electrostatic classifier is set to the electrical mobility of the desired particles in step 440. As explained in conjunction with FIG. 3, particles from the first electrostatic classifier will be subjected to a new charge distribution when passed through the neutralizer of the second electrostatic classifier. Because the desired particles, the majority of which are now singly-charged, have an electrical mobility different than the other particles selected by the first electrostatic classifier (the majority of which are also singly-charged), the particles can again be separated. In the hypothetical, the desired more linearly shaped particles can be separated from other aerosol components.

Figure 5:
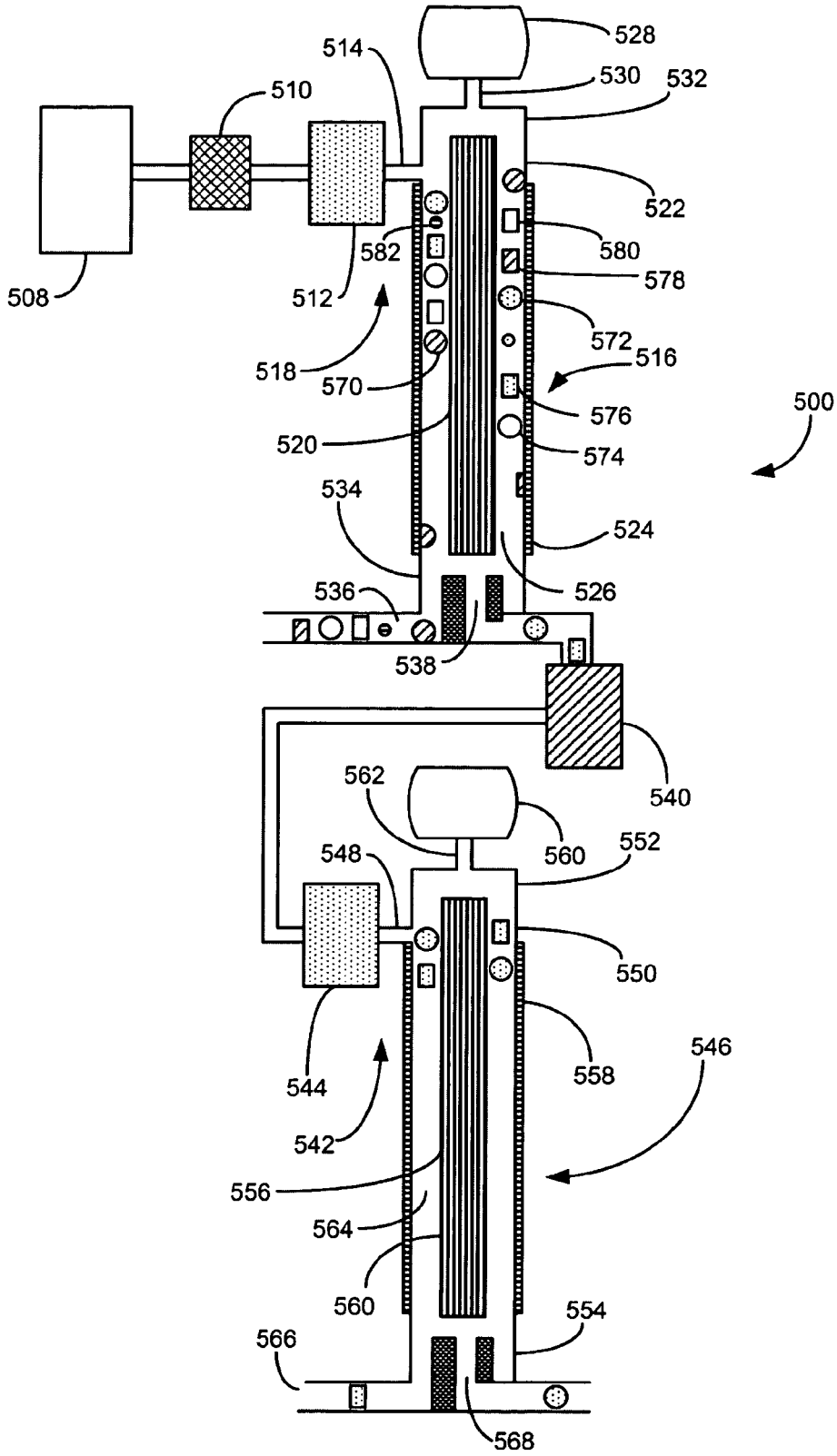
FIG. 5 is a schematic diagram of a system that can be used to separate particles of different morphologies based on their charge.

FIG. 5 illustrates a more specific embodiment 500 of the system 100 of FIG. 1 that can carry out the process shown in FIG. 2. In the system 500, two electrostatic classifiers are used to at least partially separate a sample into different morphologies. A sample source 508 is fluidly coupled to a pretreatment unit 510, such as an impactor. An exit stream from the pretreatment unit 510 is fluidly coupled to a first neutralizer 512. In some examples, the first neutralizer 512 is a Model 3077 or 3077A neutralizer, available from TSI Inc., of Shoreview, Minn. The neutralizer 512 is coupled to a sample inlet 514 of a first differential mobility analyzer 516. Together, the first neutralizer 514 and the first differential mobility analyzer 516 form a first electrostatic classifier 518.

The first differential mobility analyzer 516 includes an inner rod electrode 520 disposed in a housing 522. The housing 522 is typically cylindrical but may be constructed in other geometric shapes. An outer electrode 524 is located adjacent the housing 522. In some configurations, the outer electrode 524 and the housing 522 are the same structure, in other configurations they are different structures.

The section 526 between the outer electrode 524 and the inner electrode 520 forms a flow sheath. The sheath 526 is fluidly coupled to a source of sheath fluid 528 through a sheath fluid inlet 530 at a first end 532 of the differential mobility analyzer 516.

At a second end 534 of the differential mobility analyzer 516, an exhaust outlet 536 is located at the periphery of the housing 522. A central sample outlet 538 is optionally fluidly coupled to an intermediate treatment unit 540. The intermediate transfer unit 540 may, for example, be used to condition or alter the particles before further separation or processing.

The sample outlet 538 is further fluidly coupled to a second electrostatic classifier 542. The second electrostatic classifier 542 includes a neutralizer 544 and a differential mobility analyzer 546 that includes a sample inlet 548, a housing 550 having a first end 552 and a second end 554, an inner electrode 556, an outer electrode 558, a sheath fluid source 560, a sheath fluid inlet, 562, a sheath 564, an exhaust outlet 566, and a sample outlet 568. In at least one configuration, the components of the electrostatic classifier 542 are generally as described for the electrostatic classifier 518.

In some examples of the system 500, the intermediate transfer unit 540 is omitted and the sample outlet 538 is directly coupled to the second electrostatic classifier 542. In yet further embodiments, the neutralizer 544 is omitted and the sample outlet 538, or the intermediate unit 540, if used, is connected directly to the sample inlet 548.

The system 500 operates as follows. A sample source 508 produces or transmits a mixed sample to the pretreatment unit 510. When the pretreatment unit 510 is an impactor, the impactor separates particles having a predetermined size range and transmits the refined sample to the neutralizer 512.

The neutralizer 512 applies charge to the sample particles. After passing through the neutralizer 512, the particles will have a charge that depends, at least to an extent, on the size and morphology of the particle. As an example, seven types of particles are illustrated in FIG. 5

The sample includes particles having a first morphology and a first electrical mobility-to-charge ratio and bearing one or more negative charges 570, one or more positive charges 572, or being neutral 574. Similarly, particles of a second morphology and having the first electrical mobility-to-charge ratio are positively charged 576, negatively charged 578, or are neutral 580. In a specific example, the positively charged particles of the first morphology 572 bear two elementary charges and the positively charged particles of the second morphology 576 bear a single elementary charge. The sample also includes particles 582 of a second electrical mobility-to-charge ratio, the charges of which are not specified in FIG. 5.

When the inner electrode 520 is negatively charged and the outer electrode 524 is positively charged, the negatively charged particles 570, 578 will be drawn towards the outer electrode 524. At least a portion of the particles 570, 578 may impact the outer electrode 524. Particles 570, 578 that do not impact the electrode 524 have a trajectory that causes them to enter the exhaust outlet 536. In other configurations, the charges on the electrodes 520, 524 are reversed or one is uncharged.

The neutral particles 574, 580 are not attracted to either of the electrodes 520, 524 and have a trajectory though the sheath 526 that carries them to the exhaust outlet 536.

The positively charged particles 572, 576 are attracted towards the inner electrode 520. Some of the particles 572, 576 have an electrical mobility-to-charge ratio that imparts a trajectory in the sheath 526 that carries the particles 572, 576 to the sample outlet 538. For example, when the first differential mobility analyzer is set to select as its primary mode particles 576 (that is, singly-charged particles having the mobility diameter of the particles 576), it will also transmit particles 572, which, when doubly-charged, have a mobility diameter that is approximately double that of the particles 576. Particles outside of the selected electrical mobility-to-charge ratio 582 have a trajectory that carries them to the exhaust outlet 536, regardless of their charge.

Particles in the exhaust outlet 536 may be removed from the system 500 or, in some configurations, returned to the differential mobility analyzer 516, such as with the sheath fluid source 528. When returned to the differential mobility analyzer 516, the exhaust from outlet 536 may be treated, such as being filtered to remove all or a portion of the particles carried through the outlet 536. The particles 572, 576 passing through the sample outlet 538 are, at least in some implementations, carried through the intermediate treatment unit 540. In a particle example, the intermediate transfer unit 540 changes the morphology of one or more of the particles 572, 576, such as by applying a charge to deform the particles.

In at least some configurations, the particles 572, 576 from the outlet 538 or the intermediate transfer unit 540 pass through the neutralizer 544. The neutralizer 544 imparts a new charge distribution to the particles 572, 576. The differential mobility analyzer 546 is configured to select singly-charged particles having the mobility diameter of particles 572.

As shown in FIG. 5, particles 572 are transmitted by the differential mobility analyzer 546 through the sample outlet 568, where the particles 572 may be collected, detected, or subjected to additional processing steps. The particles 576 no longer have a mobility diameter that is selected by the differential mobility analyzer 546 and pass into the exhaust outlet 566. The particles 576 can then be collected, detected, subjected to additional processing steps, or merely discarded.

The properties of the differential mobility analyzers 516, 546 can be adjusted to provide a desired separation. The particle diameter, $D_p$, can be related to other parameters of a differential mobility analyzer by Equation 3 below:

$$\frac{Dp}{C} = \frac{2neVL}{3\mu q_{sh} \ln\frac{r_2}{r_1}} \tag{3}$$

In Equation 3, C is the Cunningham slip correction factor (defined below), n is the number of elementary charges on a particle (typically an integer), e is the elementary charge, V is the average voltage on the inner electrode, L is the length between the sample inlet and the sample selection outlet, μ is the gas viscosity, $q_{sh}$ is the sheath air flow rate, $r_2$ is the outer radius of the annular space (the distance between the center of the differential mobility analyzer and the outer electrode) and $r_1$ is the inner radius of annular space (the distance between the center of the differential mobility analyzer and the outer surface of the inner electrode).

The Cunningham slip corrected factor is defined in the following equation:

$$1+\mathrm{Kn}[\alpha+\beta^{-\gamma/Kn}] \tag{4}$$

In Equation 4, α is 1.42, β is 0.558, and γ is 0.999. Kn is the Knudsen Number, or $2\lambda/D_p$, where λ is the gas mean free path, or:

$$\lambda_r\left(\frac{P_r}{P}\right)\left(\frac{T}{T_r}\right)\left(\frac{1+S/T_r}{1+S/T}\right) \tag{5}$$

In Equation 5, S is the Sutherland constant, T is the temperature, P is the particle size, and $T_r$, $P_r$, and $\lambda_r$ are reference temperature, particle diameter, and mean free path values.

The gas viscosity, μ, is defined as:

$$\mu_r\left(\frac{T_r+S}{T+S}\right)\left(\frac{T}{T_r}\right)^{\frac{3}{2}} \tag{6}$$

From Equation 3, it can be seen that the parameters of the differential mobility analyzers 516, 546 can be adjusted to select particles having a particular number of elementary charges n. For example, Equation 3 suggests that higher flow rates q h or lower inner electrode voltages V will favor selection of particles having higher numbers of elementary charges.

As explained above, the first differential mobility analyzer 516 is used to select, from a bulk stream of particles, those having a specific electrical mobility-to-charge ratio. In order to transmit a high amount of such particles, the first differential mobility analyzer 516 is typically configured to transmit singly-charged particles but will also transmit multiply-charged particles.

The operational parameters of the differential mobility analyzers 516, 546 depend on a number of factors, such as the particle sizes entering the analyzers and their charge or charge distribution. For materials whose properties are known, particles having the morphology and size desired influence the operational parameters of the differential mobility analyzers 516, 546, such as sample flow rate, sheath flow rate, and electrode charge. Those operational parameters can then be varied to produce a combination that selects the desired particles. For example, setting the electrode charges at a particular value requires the other parameters to be set at complementary values for a particular particle size and particle charge.

The inner electrode 520 and outer electrodes typically have a charge of between about 0 V and about 50,000 V, such as between about 1000 V and about 25,000 V or between about 5000 V and about 15,000 V. The sample flow rate is typically between about 0.05 l/min and about 50 l/min, such as between about 0.5 l/min and about 10 l/min or between about 1 l/min and about 5 l/min. The sheath flow rate is typically between about 0.5 l/min and about 500 l/min, such as between about 5 l/min and about 100 l/min or between about 10 l/min and about 50 l/min.

The ratio of sample-to-sheath flow may also influence the separation of particles. For example, as the sheath flow increases relative to the sample flow, a finer separation (a narrow range of selected particles) can be obtained. However, at higher sheath flow rates, the concentration of selected particles is typically lower. Thus, when higher concentrations or larger numbers of particles are desired, it may be beneficial to lower sheath flow rates (that is, use higher sample-to-sheath flow ratios). In some examples, the sample-to-sheath flow rate is between about 1:2 and about 1:20, such as between about 1:3: and about 1:0. In a more specific example, the sample-to-sheath flow ratio is about 1:4. When higher ratios are used the particles can be pretreated to account for the potentially coarser separation, such as by passing the particles through an impactor or other size-selection device.

The following Example is provided to illustrate specific features of one disclosed embodiment of the present disclosure. A person of ordinary skill in the art will understand that the scope of the present disclosure is not limited to these particular features.

EXAMPLE

This Example demonstrates that aspherical particles (in particular, fractal-like agglomerates) can be electrically charged and that particle morphology is related to the charge on the particle. The separator used in this Example is an electrostatic classifier ("EC"), a neutralizer combined with a differential mobility analyzer.

The EC utilizes a combination of a viscous and electrostatic force to select a combination of charge q and aerodynamic particle size with a spatial gate. Although ECs are used for particle sizing and for the generation of monodisperse aerosols in the size range from 0.005 to 1.0 μm, they do not appear to have been used to separate particles based on morphology.

Typically, an EC passes a polydisperse sample through a neutralizer, such as a Kr-85 radioactive charge neutralizer, where particles attain a Boltzmann charge distribution. A known size fraction of charged particles are extracted using a spatially varying electric field. The velocity of the extracted fraction of particles inside an EC is a function of the field strength and of the particle electrical mobility, which is in turn a function of the particle net charge (q) and mobility diameter ($D_m$). If an EC is set to predominantly size-select particles with a specific mobility diameter $D_m$ and q=−e, it also transmits a certain percentage of particles with charge −ie and mobility diameter ~−ie$D_m$, where i is an integer number. At any EC setting, depending on the polydispersivity of the particle size distribution, multiple particle size modes are being transmitted with up to three modes being significant for particle diameters below 0.5 μm.

In this Example, ECs were configured to select cluster-dilute agglomerates with identical $D_m$ but carrying a) predominantly q=−e, and b) predominantly q=−2e. The cluster-dilute regime is defined as when the ratio of the mean cluster nearest-neighbor separation to cluster size is large. Quantitative analysis of agglomerate morphology with the help of a Scanning Electron Microscope ("SEM") and image processing techniques showed that agglomerates with predominantly q=−2e possess very different ensemble morphology when compared to those with q=−e. This morphology difference was observed for both short-chained (~220 nm) and sub-micron-sized (~500-1000 nm) agglomerates.

System Details:

Nanometer-scale soot aerosol agglomerates were produced using flame synthesis, which is a well-established industrial technology for producing aerosols on a large-scale. A schematic diagram of the experimental set-up is illustrated in FIG. 4. Soot agglomerates were produced by a premixed flame supported on a cooled porous frit burner (Holthuis & Associates, Sebastopol, Calif.) through combustion of ethene (1.4-4.2 l $min^{-1}$ STP) and oxygen (2.0-4.5 l $min^{-1}$ STP) premixed with a dilution flow of nitrogen (1.0-5.0 l $min^{-1}$ STP) and surrounded by an $N_2$ sheath flow (~25 l $min^{-1}$ STP).

The premixed gases were passed through a 6-cm diameter porous frit, which in turn was surrounded by a 0.5-cm wide annular sheath region through which $N_2$ was passed. The flame was maintained at an equivalence ratio ϕ of 2.8. The equivalence ratio ϕ is defined as the fuel to oxygen ratio divided by the stoichiometric fuel-to-oxygen ratio which can be written as:

$$\varphi = \frac{n_{fuel}/n_{oxygen}}{(n_{fuel}/n_{oxygen})_{stoich}} \tag{7}$$

In Equation 7, n stands for the number of moles of fuel or oxygen. In this Example, the flame was maintained at a fuel-rich ϕ of 2.8 to obtain soot with a high ratio of black-carbon to organic carbon. The premixed gas and sheath flows were contained by glass housing shaped to minimize convective mixing, thereby ensuring that the flame stoichiometry was well-characterized at the point of sampling.

Prior to sampling, the flatness of the flame, i.e. uniformity across a given flame cross-section was checked. A diagram of the sampling tip is shown in the inset to FIG. 6. The sampling tip consisted of two concentric stainless steel tubes with particles carried up the inner tube while a separate nitrogen carrier gas (14.5 l $min^{-1}$ STP) was passed down the outer tube and then back up the inner tube. The gas flow around the lip of the inner tube helped reduce soot buildup in this region and dilute the particle concentration.

Particle sampling was carried out in the overfire region of the flame, where the characteristic flame residence times are roughly an order of magnitude longer than the laminar smoke point residence time. Soot particles in the long residence time regime are fully formed into agglomerates and their properties are fairly independent of position, which facilitates sampling of a steady and uniform distribution of particles.

Figure 6:
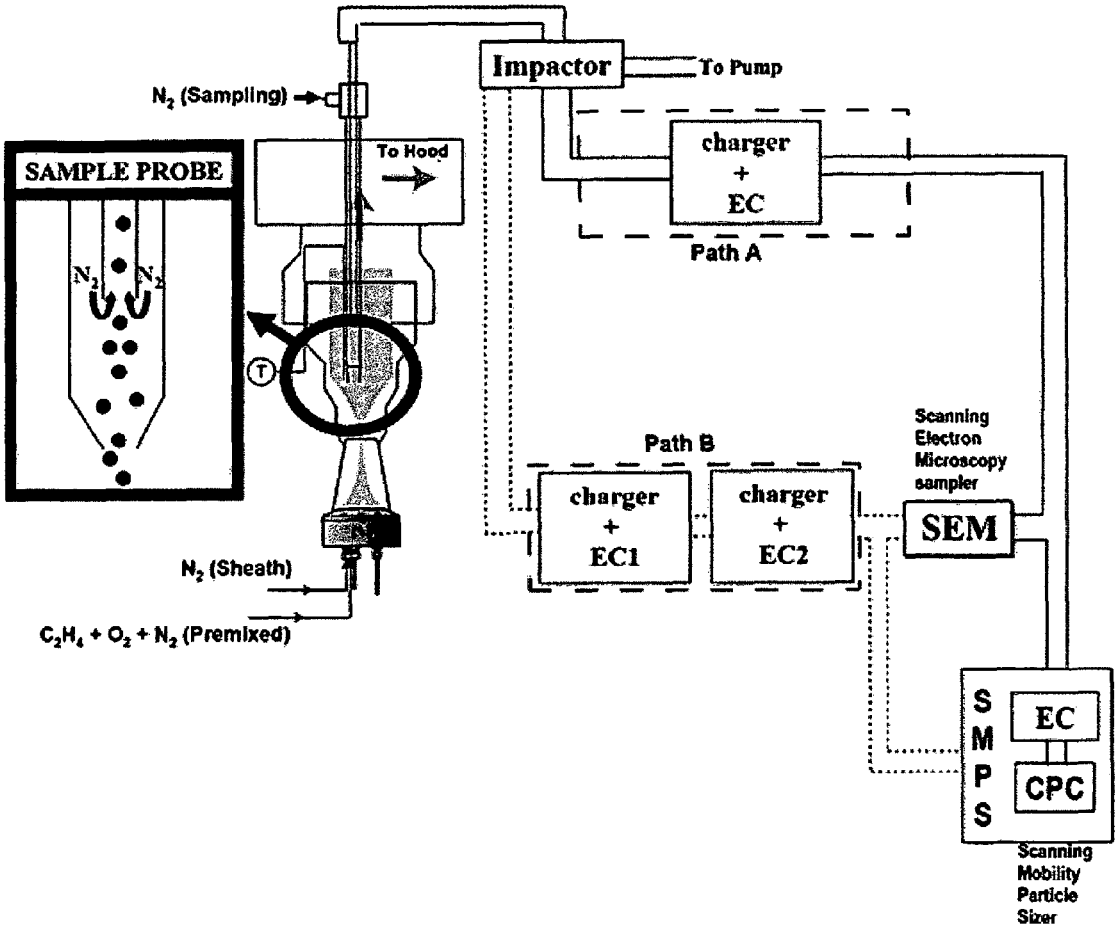
FIG. 6 is a schematic diagram of a system for soot generation, separation, and characterization.

The gas flow carrying the diluted soot particles was then passed through an impactor to remove particles larger than about 5 μm in diameter. Sample flow exiting the impactor was directed through either path A containing a single EC, or through path B containing two ECs in series (FIG. 6). The particles were bipolarly charged using a neutralizer (Model Kr-85, TSI Inc., Shoreview, Minn.) before entering any of the identical ECs (Model 3080, TSI Inc., Shoreview, Minn.).

Two set of experiments were carried out using the set-up with identical operating conditions for studying charge-related differences in agglomerate morphology corresponding to $D_m$=220 and 460 nm respectively. For each set of experiments, the EC in path A was set to predominantly size select soot particles with q=−e and a $D_m$ (either 220 or 460 nm). In path B the sheath flow-rate of the first EC was adjusted such that the second (q=2e) mode of particles exiting the EC corresponded to the $D_m$ in path A. In other words, the second EC size selected as its predominant (q=−e) mode the q=−2e mode particles exiting the first EC. For example, in order to size select doubly-charged $D_m$=220 nm particles in path B, the 1st EC was set to select singly-charged particles with $D_m$=142 nm, which would also transmit doubly-charged particles with $D_m$=220 nm. These particles were neutralized and sent to the 2nd EC, which was set to select singly-charged particles with $D_m$=220 nm.

In this Example, the $D_m$=460 nm particles were classified using ECs at sheath flow rates of around 5 l $min^{-1}$, and the $D_m$=220 nm particles were classified at flow rates of around 8 l $min^{-1}$. The sheath flow rates of the ECs and the electrical fields, during both set of our experiments, were maintained nearly constant so that they would have a negligible effect on particle alignment. There was a sharp decrease in the particle concentration exiting pathway B, likely because of use of charge neutralizers before both the ECs. Accordingly, the aerosol to sheath flow-rate ratios in the ECs for both the pathways were maintained at around 1:4, thereby assuring sufficiently high particle concentrations in path B. Under these flow conditions, the resolution of the EC in path A was approximately ±30%. The serial combination of the two ECs in path B yielded a resolution of approximately ±20%. The ECs were calibrated using National Institute of Standards and Technology (NIST) certified Polystyrene Sphere Latex (PSL) particle size standards.

The particle flow exiting each pathway was isokinetically split into a particle sampling unit for SEM, and a scanning mobility particle sizer ("SMPS," Model 3936, TSI Inc., Shoreview, Minn.). The SMPS, which consists of an EC and a condensation particle counter (CPC), yields the particle number size distribution in terms of a Gaussian expression for particles with $D_m$<1000 nm. In this study the flow rate of the SMPS was set to measure only particles smaller than $D_m$=670 nm. For each set of experiments, both the SMPS and the SEM filter sampling were synchronized for one pathway at a time during each set of experiments.

For SEM analysis, soot particles were impacted onto 10-μm thick nuclepore clear polycarbonate 13-mm diameter filters (Whatman Inc., Chicago, Ill.) mounted on Costar Pop-Top Membrane holders (Corning Inc., Corning, N.Y.). An oil-free pump was used to draw soot particles at a flow rate of 2 l/min STP through copper tubing onto the nuclepore filters. The filter exposure time was adjusted to yield a moderate filter loading conducive for performing image analysis of individual agglomerates.

After sampling, the filter samples were kept in refrigerated storage and later prepared for SEM analysis by coating them with a 1-nm thick layer of platinum to prevent particle charging during SEM analysis. The coated filters were analyzed using a Hitachi Scanning Electron Microscope (Model S-4700).

SEM analysis may change the shape of particles through heat damage and physical damage. Heat damage evaporates semi-volatile components from the filter due to the high accelerating voltage of the electron beam (>20 kV) operating under vacuum conditions. Physical damage distorts the original particle shape because of particle charging by the electron beam. In this Example, a relatively moderate accelerating voltage of 20 kV was used for most images. Compared to lower accelerating voltages, the use of 20 kV improves imaging of the surface and internal structure of the particles. At this operating voltage, shape distortion due to charging was observed in less than 3% of the aggregates.

Results and Discussion

Two-dimensional (2-d) SEM images of about 300-400 soot agglomerates corresponding to each diameter and net charge were analyzed for morphology and shape quantification using commercial image analysis software (Digital Micrograph 3, Gatan Inc., Pleasanton, Calif.) and custom image processing routines.

An empirical formula for calculating the three dimensional (3-d) mass fractal dimension D of agglomerates is:

$$N = k\left(\frac{L_{max}}{d_p}\right)^D \tag{8}$$

In Equation 8, N is the number of monomers constituting the agglomerate, $d_p$ is the mean monomer diameter, $L_{max}$ is the maximum projected length of the agglomerate, and k is an empirical constant. For soot particles formed via dilute diffusion limited agglomeration processes, such as in a flame, D<2 and the projected 2-d D can be assumed to be approximately equal to the 3-d D.

However, for a finite-sized, 3-d fractal agglomerate, it has been found that parts of the agglomerate can randomly screen other parts during 2-d imaging. This screening can be corrected for through a calculation of N as:

$$N = \left(\frac{A_{agg}}{A_{mon}}\right)^{\kappa} \tag{9}$$

In Equation 9, a value of κ=1.10 is used to account for the 2-d screening effect, $A_{agg}$ is the agglomerate projected area, and $A_{mon}$ is the mean cross-sectional monomer area. Particle properties quantified using image analysis include $A_{agg}$, $A_{mon}$, $d_p$, and $L_{max}$ as previously defined and maximum projected width $W_{max}$ normal to $L_{max}$. Distribution of agglomerate projected area equivalent diameter $D_{eq}$, defined as the diameter of a circle of the same area as the particle under consideration, was calculated for all individual agglomerates and compared to the $D_m$ distribution of the SMPS.

Figure 7:
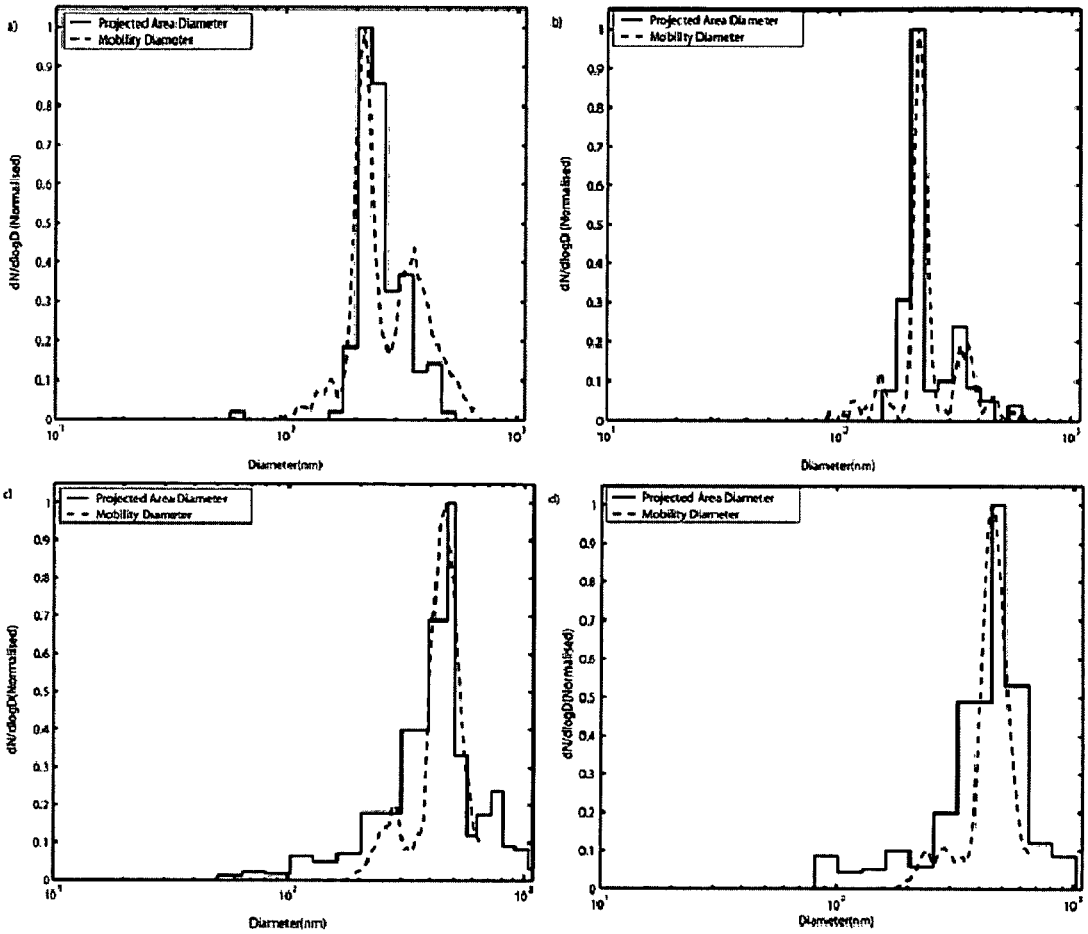
FIGS. 7(*a*)-7(*d*) provide graphs of the change in the number of agglomerate particles versus the change in the log of mass fractal dimension plotted against equivalent diameter ($D_{eq}$, nm) and SMPS mobility diameter ($D_m$, nm) number size distribution for (a) soot particles with $D_m$=220 nm and q=−e, (b) soot particles with $D_m$=220 nm and q=−2e, (c) soot particles with $D_m$=460 nm and q=−e, and (d) soot particles $D_m$=460 nm and q=−2e.

FIGS. 7(*a*) and 7 (*b*) illustrate that the normalized number size distribution plot of $D_{eq}$ and $D_m$ (measured by SMPS) for q=−e and q=−2e particles corresponding to $D_m$=220 nm, while FIGS. 7(*c*) and 7(*d*) present similar plots for particles corresponding to $D_m$=460 nm. The predominant modes are comparable in each case. Higher modes could not be compared for 460 nm agglomerates, since the SMPS measures only particle diameters below 670 nm. The predominant peaks of the SEM $D_{eq}$ number size distribution in FIG. 7 scale with the SMPS $D_m$ distribution as $D_{eq}$~$D_m^{\alpha}$, where α is the exponent characterizing the power law relationship. For both size distributions, α was found to be approximately one. These empirical relationships helped to specifically segregate out only those particles from SEM images which were centered around 220/460 nm for morphology analysis. The larger particles corresponding to the multiply-charged modes were not included for morphology analysis.

Mass fractal dimension D for the agglomerates was calculated using a) Equation 7, and b) the box counting technique. The box counting technique involves calculating the number of cells required to entirely cover a particle using grids of cells of varying size. The logarithm of the number of occupied cells versus the logarithm of the size of one cell gives a line whose gradient corresponds to the fractal dimension of the particle.

Two shape descriptors, aspect ratio and roundness, were calculated from the projected particle properties. These descriptors are sensitive to particle elongation. The scaling exponent β of the power-law relationship between $L_{max}$~$D_{eq}^{\beta}$, another parameter indicative of particle elongation, was also calculated for each of the agglomerates.

For spherical particle charging in a bipolar ionic environment, the Boltzmann distribution is a good approximation for calculating the fraction of particles carrying charge −ie, where i is an integer greater than or equal to. For D<2 agglomerates the same approximation, after a slight modification in its formulation, was also found to hold good within 10%. The modification replaced the physical diameter term in the Boltzmann distribution expression with a parameter called the charging equivalent diameter $D_{qe}$ for fractal-like agglomerates.

The $D_{qe}$ of the individual agglomerates was calculated, which in turn is a direct representative of the average net-charge residing on the agglomerates. Each $D_{qe}$ was then scaled with its respective $D_{eq}$ (which is approximately equal to $D_m$) as $D_{qe}$~$D_{eq}^{\gamma}$, where γ is the power law relationship exponent. Table 1 lists the mean values of all the analyzed 2-d morphological parameters from SEM images of particles with q=−e and q=−2e, and corresponding to $D_m$=220 nm and 460 nm respectively.

Figure 8:
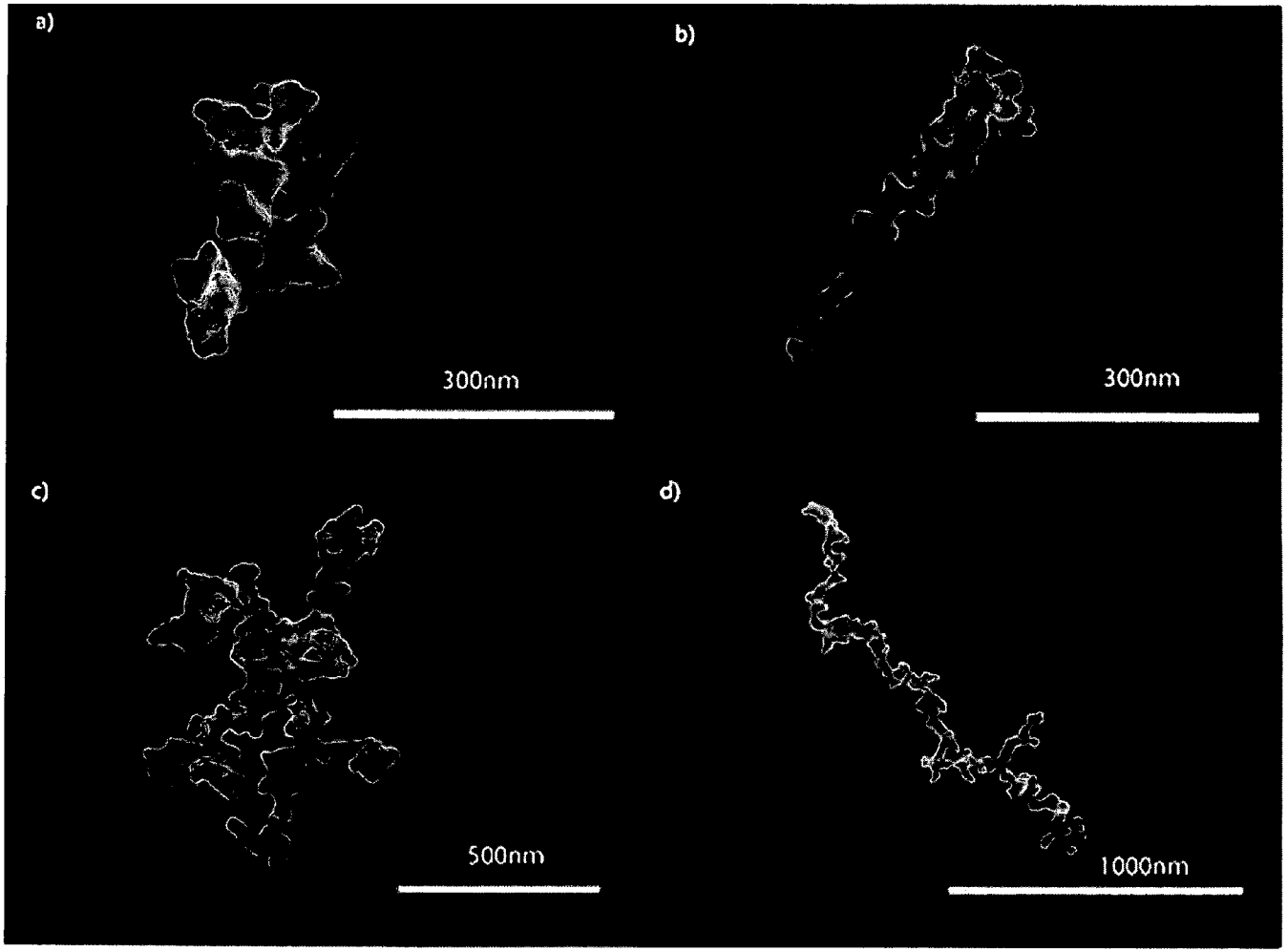
FIGS. 8(*a*)-8(*d*) are electron microscopy images of for (a) soot particles with $D_m$=220 nm and q=−e, (b) soot particles with $D_m$=220 nm and q=−2e, (c) soot particles with $D_m$=460 nm and q=−e, and (d) soot particles $D_m$=460 nm and q=−2e.

The analysis results summarized in Table 1 imply that for soot agglomerates produced under similar flame conditions and possessing the same mobility diameter, the morphology of doubly-charged (q=−2e) particles is distinctly different from that of singly-charged (q=−e) particles. The lower values of fractal dimensions and shape descriptors suggest a more elongated and open morphology for q=−2e particles compared to q=−e particles, which possess more compact and rounded morphology. Typical morphologies of singly and doubly-charged agglomerates for mobility diameters of 220 nm and 460 nm are shown in FIG. 8. The values of D observed in this study for the singly-charged particles, of $D_m$=220 nm and 460 nm, correspond with previously reported values of D for soot agglomerates grown via diffusion-limited-agglomeration process in pre-mixed flames.

TABLE 1

Calculated values of agglomerate morphological properties

| $D_m$ and q | A ($D_{eq}$~$D_m^{\alpha}$) | β ($L_{max}$~$D_{eq}^{\beta}$) | γ ($D_{ge}$~$D_{eq}^{\gamma}$) | D (using Equation 1) | D (Box-counting method) | Aspect Ratio | Roundness |
|---|---|---|---|---|---|---|---|
| 220 nm q = −e | 1.01 ± .01 | 1.19 ± .03 | 1.14 ± .04 | 1.63 ± .04 | 1.75 ± .10 | 0.66 ± .14 | 0.73 ± .14 |
| 220 nm q = −2e | 1.01 ± .01 | 1.43 ± .06 | 1.26 ± .03 | 1.43 ± .05 | 1.46 ± .11 | 0.51 ± .15 | 0.59 ± .15 |
| 460 nm q = −e | 1.15 ± .02 | 1.21 ± .05 | 1.10 ± .05 | 1.70 ± .07 | 1.77 ± .12 | 0.73 ± .16 | 0.68 ± .16 |
| 460 nm q = −2e | 1.1 ± .01 | 1.55 ± .04 | 1.34 ± .05 | 1.3 ± .06 | 1.41 ± .10 | 0.47 ± .14 | 0.41 ± .14 |

The higher value of the charging equivalent diameters for q=−2e agglomerates suggest more over-equilibrium charge deposited on them than their counterpart agglomerates with q=−e. This observation is can be explained by considering that the likelihood of a particle acquiring a certain number of charges in the charging process depends on its morphology. Elongated particles are more likely to acquire a second charge than spherical particles because, for the same particle mass, the second charge can be located at a larger distance from the first charge. The larger separation between the charges requires less energy for charging to occur and increases the charging probability. Lower temperatures may produce even better charge separation, further increasing the charging probability.

It is to be understood that the above discussion provides a detailed description of various embodiments. The above descriptions will enable those of ordinary skill in the art to make and use the disclosed embodiments, and to make departures from the particular examples described above to provide embodiments of the methods and apparatuses constructed in accordance with the present disclosure. The embodiments are illustrative, and not intended to limit the scope of the present disclosure. The scope of the present disclosure is rather to be determined by the scope of the claims as issued and equivalents thereto.

We claim:

1. A method for separating particles, comprising:

dispersing a plurality of particles in a fluid to form an aerosol, a portion of the particles having a first morphology and a portion of the particles having a second morphology;

charging at least a portion of the particles to produce a charged aerosol, the charged aerosol comprising particles having a first electrical mobility-to-charge ratio, comprising particles of the first morphology and particles of the second morphology, and particles having a second electrical mobility-to-charge ratio;

separating the particles of the first electrical mobility-to-charge ratio from the particles of the second electrical mobility-to-charge ratio, the separated particles of the first electrical mobility-to-charge ratio being selected particles;

charging the selected particles to produce particles of the first morphology having a first electrical mobility and particles of the second morphology having a second electrical mobility; and separating particles of the first electrical mobility from particles of the second electrical mobility.

2. The method of claim 1, wherein separating particles of the first electrical mobility-to-charge ratio from particles of the second electrical mobility-to-charge ratio comprises passing the aerosol through a first differential mobility analyzer.

3. The method of claim 2, wherein separating particles of the first electrical mobility from particles of the second electrical mobility comprises passing the aerosol through a second differential mobility analyzer.

4. The method of claim 3, wherein the second differential mobility analyzer selects as its primary mode the electrical mobility of a multiply-charged particle having the first electrical mobility-to-charge ratio.

5. The method of claim 3, wherein the first and second differential mobility analyzers have a sample flow rate and a sheath flow rate and the ratio of the sample flow rate to the sheath flow rate is greater than 1:5.

6. The method of claim 1, wherein charging the aerosol produces a distribution of charges, and the method further comprising cooling the aerosol to produce a higher concentration of particles having the first electrical mobility.

7. The method of claim 1, wherein the first and second morphologies are differently shaped agglomerates.

8. A method for separating particles, comprising:

dispersing a plurality of particles in a fluid to form an aerosol, a portion of the particles having a first morphology and a portion of the particles having a second morphology;

applying a charge to at least a portion of the particles to produce a charged aerosol, the particles in the charged aerosol being neutral or charged;

passing the charged aerosol through a separator, the particles having flow properties as they pass through the separator;

altering the flow properties of at least a portion of the particles; and separating at least a portion of the particles of the first morphology from the particles of the second morphology to produce a product stream having a higher concentration of particles of the first morphology and an exhaust stream having a higher concentration of particles of the second morphology.

9. The method of claim 8, wherein altering flow properties of at least a portion of the particles comprises passing the charged aerosol proximate a first charged electrode, the first charged electrode attracting a greater proportion of particles of the first morphology than particles of the second morphology.

10. The method of claim 9, wherein altering flow properties of at least a portion of the particles further comprises passing the particles proximate a second charged electrode, the first charged electrode and the second charged electrode altering the flow path of at least a portion of the particles of the first morphology such that the product stream is concentrated in particles of the first morphology.

11. The method of claim 8, wherein altering the properties of at least a portion of the particles comprises passing the particles through a flow chamber having a first outlet and a second outlet, the product stream passing through the first outlet and the exhaust stream passing through the second outlet.

12. The method of claim 11, wherein the flow chamber comprises a differential mobility analyzer.

13. The method of claim 8, wherein the aerosol is polydisperse in particle electrical mobility and comprises particles having a first electrical mobility and particles having a second electrical mobility, the second electrical mobility being any electrical mobility other than the first electrical mobility, the particles of the first and second morphologies having the first electrical mobility, and wherein separating particles of the first morphology from particles of the second morphology comprises:

separating particles having the first electrical mobility from particles having the second electrical mobility to produce an at least substantially electrical mobility monodisperse stream of particles of the first electrical mobility; and separating particles having the first morphology from the monodisperse stream.

14. The method of claim 13, wherein separating particles having first electrical mobility comprises passing the aerosol thorough a differential mobility analyzer.

15. The method of claim 13, wherein separating particles having the first morphology from the monodisperse stream comprises passing the monodisperse stream through a differential mobility analyzer.

16. The method of claim 15, wherein passing the monodisperse stream through a differential mobility analyzer comprises charging the monodisperse stream.

17. A method for separating particles, comprising:

charging an aerosol comprising particles of a first morphology and a second morphology to produce a first distribution of a flow property;

separating particles based on the first distribution;

charging the aerosol to produce a second distribution of a flow property; and separating particles based on the second distribution;

whereby separating particles based on the first and second distributions separates particles of the first and second morphologies.

18. The method of claim 17, wherein the flow property is electrical mobility.

19. The method of claim 18, further comprising cooling the aerosol to influence the first distribution and enhance separation of the first and second morphologies.

20. The method of claim 19, wherein charging the aerosol to produce a second distribution of a flow property comprises forming a polydisperse sample in the flow property from a monodisperse sample in the flow property.

* * * * *